US010163433B2

(12) United States Patent
Badino et al.

(10) Patent No.: US 10,163,433 B2
(45) Date of Patent: Dec. 25, 2018

(54) ACOUSTIC COMFORT IN THE PASSENGER COMPARTMENT OF A MOTOR VEHICLE

(71) Applicant: FCA Italy S.p.A., Turin (IT)

(72) Inventors: Renato Badino, Turin (IT); Stefano Luca, Turin (IT)

(73) Assignee: FCA Italy S.p.A., Turin (IT)

( * ) Notice: Subject to any disclaimer, the term of this patent is extended or adjusted under 35 U.S.C. 154(b) by 0 days.

(21) Appl. No.: 15/975,088

(22) Filed: May 9, 2018

(65) Prior Publication Data

US 2018/0330710 A1 Nov. 15, 2018

(30) Foreign Application Priority Data

May 10, 2017 (EP) ..... 17170517

(51) Int. Cl.
*H04R 3/00* (2006.01)
*G10K 11/178* (2006.01)

(52) U.S. Cl.
CPC .... *G10K 11/178* (2013.01); *G10K 2210/1282* (2013.01); *G10K 2210/3018* (2013.01); *G10K 2210/3046* (2013.01)

(58) Field of Classification Search
CPC ..... F41A 21/30; F24F 13/24; G10K 11/172; G10K 11/175; G10K 11/178–11/17885;
(Continued)

(56) References Cited

U.S. PATENT DOCUMENTS 5,954,169 A * 9/1999 Jensen ..... F16F 7/1005 188/378
5,967,623 A * 10/1999 Agnew ..... B60T 8/368 138/26

(Continued)

FOREIGN PATENT DOCUMENTS

CN 105872908 A 8/2016
JP S63170699 A 7/1988

(Continued)

OTHER PUBLICATIONS

EP17170517.1 : Search Report dated Dec. 1, 2017 (6 Pages).

*Primary Examiner* — Rasha Al Aubaidi
(74) *Attorney, Agent, or Firm* — Greer, Burns & Crain, Ltd

(57) ABSTRACT

An automotive active brake noise damping system to actively damp braking noise perceivable in the passenger compartment of a motor vehicle comprising a braking system comprising a plurality of braking assemblies associated with wheels of the motor vehicle. The automotive active brake noise damping system comprises a sensory system to sense quantities that allow braking noise perceived in the passenger compartment of the motor vehicle and generated by the braking assemblies during braking to be estimated, an audio system to diffuse sounds in the passenger compartment of the motor vehicle, and an electronic control unit connected to the sensory system and the audio system, and programmed to control the audio system based on the quantities sensed by the sensor system to actively damp the braking noise perceived in the passenger compartment of the motor vehicle. The sensory system comprises vibration sensors, conveniently in the form of piezoelectric accelerators, which are applied to the braking assemblies to sense the amplitude of the vibrations generated by the braking assemblies during braking, and the electronic control unit is programmed to store a mathematical model, which correlates vibrations generated by the braking assemblies during braking with corresponding braking noise perceived in the passenger compartment of the motor vehicle and produced by the braking assemblies during braking, estimate the braking noise perceived in the passenger compartment of the motor vehicle and generated by the braking assemblies of the braking system during braking as a function of the vibrations generated by the braking assemblies (Continued)

during braking and sensed by the vibration sensors applied to the braking assemblies and of the stored mathematical model, compute an interfering sound to be diffused in the passenger compartment of the motor vehicle to damp the braking noise perceived in the passenger compartment of the motor vehicle and generated by the braking assemblies during braking, and control the audio system to cause it to diffuse the computed interfering sound.

4 Claims, 2 Drawing Sheets

(58) Field of Classification Search
CPC .. G10K 2210/128–2210/1291; H04R 2499/13
USPC ..... 381/71.1–71.14, 86, 206–224; 188/1.11 R, 1.11 E, 378, 382
See application file for complete search history.

(56) References Cited

U.S. PATENT DOCUMENTS

| | | | | |
|---|---|---|---|---|
| 8,200,406 | B2 * | 6/2012 | Stephenson | B60T 7/042 188/1.11 E |
| 8,574,323 | B2 * | 11/2013 | Green | C10L 1/003 44/447 |
| 2016/0125868 | A1 * | 5/2016 | Kautz | B60L 3/00 381/71.4 |

FOREIGN PATENT DOCUMENTS

| | | | |
|---|---|---|---|
| JP | H0454325 | A | 2/1992 |
| JP | 3328946 | B2 | 9/2002 |
| JP | 2012131315 | A | 7/2012 |
| WO | WO 99/23393 | A1 | 5/1999 |

* cited by examiner

ACOUSTIC COMFORT IN THE PASSENGER COMPARTMENT OF A MOTOR VEHICLE

RELATED APPLICATIONS

This application claims priority from European Patent Application No. 17170517.1 filed on May 10, 2017, the disclosure of which is incorporated herein by reference in its entirety.

FIELD OF THE DISCLOSURE

The invention relates, in general, to the improvement of the acoustic comfort in the passenger compartment of a motor vehicle, and in particular to the damping of the noise perceived in the passenger compartment and produced by an automotive braking assembly during braking.

BACKGROUND

As it is known, the damping of the noise perceived in the passenger compartment of a motor vehicle is still one of the key issues in the automotive industry, with the aim of improving passengers' acoustic comfort.

Basically, the damping of the noise perceived in the passenger compartment of a motor vehicle can be obtained through two different approaches, which can be used alternatively or in combination: a so-called passive approach, which is based on the use of proper soundproofing materials, and a so-called active approach, which is based on active noise control (ANC), also known as active noise cancellation (ANC), active noise reduction (ANR) or active noise damping (AND), through which the noise is reduced by adding a sound that is specifically designed to disruptively interfere with the noise, so as to mitigate it or even completely cancel it in the ideal case in which the added sound is perfectly identical to the noise but with an opposite phase.

A solution based on active noise control in the automotive industry is disclosed, for example, in DE 43 05 217 A1, wherein the noise in the passenger compartment is measured by means of sound sensors properly arranged in the passenger compartment of the motor vehicle and then is hindered by diffusing in the passenger compartment a proper sound signal by means of the loudspeakers of the stereo system of the motor vehicle.

SUMMARY OF THE INVENTION

The Applicant has found out that one of the components of the noise in the passenger compartment of a motor vehicle that turns out to be among the most annoying ones for the passengers of the motor vehicle is produced by the shrieking generated by the braking system of the motor vehicle during braking.

Even though the braking systems of the motor vehicles are properly designed, among other things, to also minimize their noise during braking, in reality the noise is never non-existent, among other things also due to the difference between the actual manufacturing and operating conditions of the braking assemblies compared to the theoretic conditions considered during the designing phase.

The containment of the sound emission in structures subjected to vibrations has been the object of a massive research effort made by the Applicant. The researched solutions can be divided into three main categories:

- reduction of the vibrations responsible for sound emission by means of passive structural reconfiguration techniques (structural changes, exploitation of sound absorbing materials, elastic supports, dynamic dampeners, etc.),
- reduction of the vibrations responsible for sound emission by means of active vibration control techniques, and
- active noise control by means of disruptive interference with a purposely generated secondary sound field.

These techniques, if considered individually, have the common feature of having an efficiency that is limited to frequency intervals that can be too narrow compared to the actual operating needs, so that only the integration of different techniques allows the features of the individual techniques to be exploited with the maximum efficiency.

Among the solutions available for the provision of active control systems, surface-applied piezoelectric materials has proven to be one of the options with the greatest potential.

Therefore, the object of the invention is to provide an active noise control-based technology capable of fruitfully exploiting the results of the Applicant's research to improve the acoustic comfort in the passenger compartment of a motor vehicle through the damping of the noise component perceived in the passenger compartment and generated by a braking system of a motor vehicle during braking.

According to invention, an automotive active noise damping system to actively damp noise in the passenger compartment of a motor vehicle is provided, as claimed in the appended claims.

DETAILED DESCRIPTION

Figure 1:
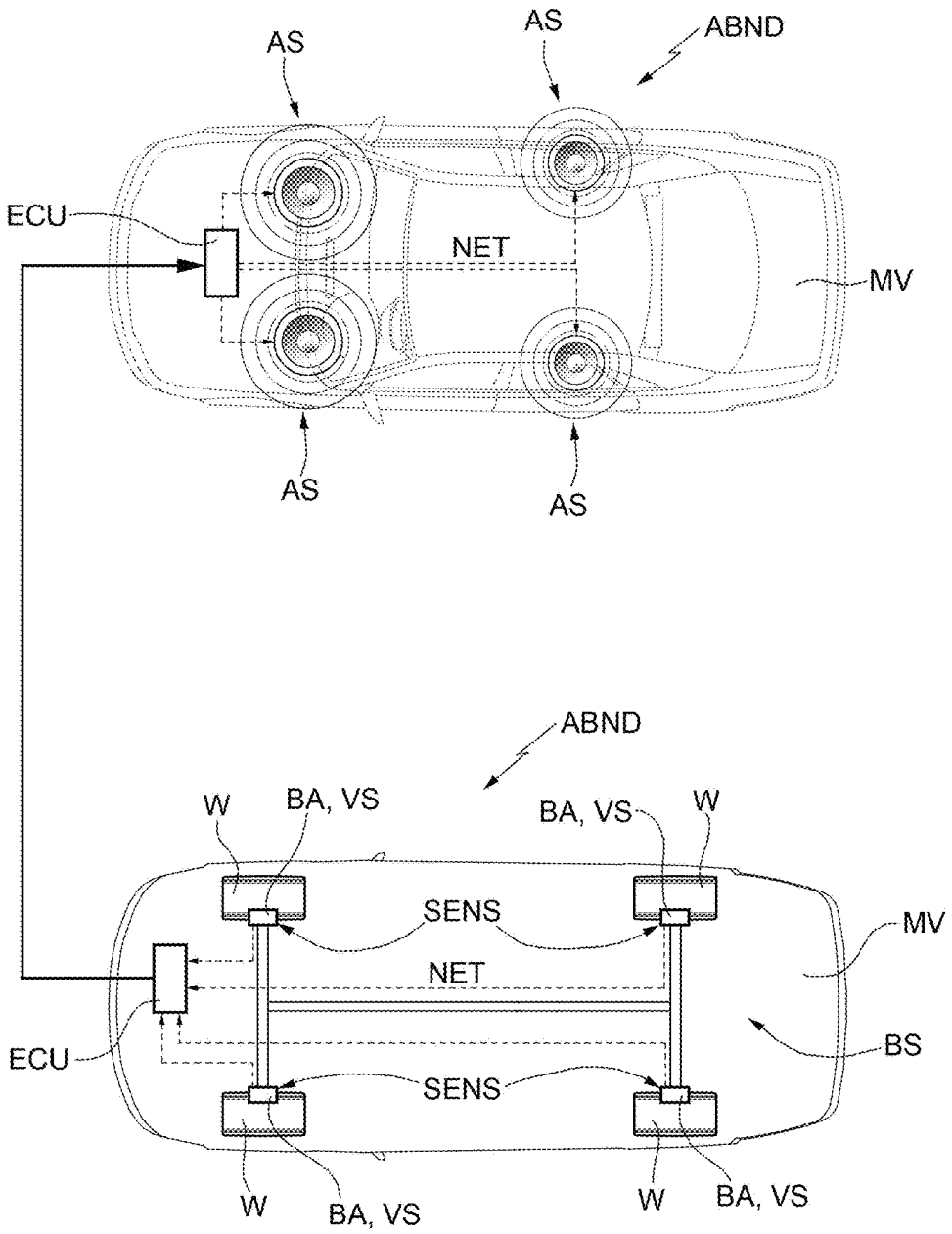
FIG. 1 shows a block diagram of an automotive active noise damping system to actively damp noise perceived in a passenger compartment of a motor vehicle and generated by a braking system of the motor vehicle during braking.

The invention will now be described in detail with reference to the accompanying figures, so as to allow a person skilled in the art to carry it out and to use it. Possible changes to the embodiments described will be immediately evident to skilled people and the generic principles described can be applied to other embodiments and applications without for this reason going beyond the scope of protection of the invention as claimed in the appended claims. Therefore, the invention is not be considered as limited to the embodiments described and shown, but it is has to be accorded the widest scope of protection in accordance with the features described and claimed herein.

As it is known, an automotive braking system basically comprises a service brake and a parking brake, wherein the service brake traditionally is hydraulic and acts upon all four wheels of the motor vehicle in response to the foot operation of a brake pedal, whereas the parking brake usually is mechanical or, in most recently produced motor vehicles as well as medium-high category motor vehicles, electric and acts upon two wheels of the motor vehicle, in particular the rear ones, in response to the manual operation of a brake lever, in case of mechanical parking brake, or to the manual operation of an electric switch, usually in combination with the foot operation of the brake pedal, in case of electric parking brake.

The service brake basically comprises four braking assemblies, each associated with a respective wheel of the motor vehicle, and a hydraulic circuit or two distinct hydraulic circuits, which are respectively associated with the front and rear braking assemblies so as to supply pressurised oil to the braking assemblies for the operation thereof The braking assemblies can be drum brakes, which are simple and economic and—for this reason—are mainly used only in small city cars, in association with the rear wheels, because of low-cost reasons and due to the reduced motor vehicle mass, which fails to force motor vehicle manufactures to use high-performance braking assemblies, or disc brake, which—for years now—have replaced drum brakes.

In drum brakes, the braking results from the action of one or more friction elements, called shoes, upon a drum, whereas, in disc brakes, the braking results from the action of friction elements, called pads, upon a braking disc, said pads being arranged on opposite sides of the braking disc and being carried by a floating caliper.

In particular, in a disc brake, the braking disc is rotatably mounted on an upright designed to be coupled to a suspension of the motor vehicle and is fixed and coaxial relative to the respective wheel, whereas the caliper is slidably coupled to two columns or pins so as to float in a direction that is parallel to the axis of the wheel when one of the two pads is subjected to the thrust of a hydraulically-operated actuator cylinder, which is part of the caliper.

As it is known, the coupling of characteristic resonance frequencies of mass components making up the braking assemblies is the origin of the annoying noise of the braking assemblies while braking, which can be largely perceived on the outside of the motor vehicle, but also on the inside of the passenger compartment of the motor vehicle, thus worsening the acoustic comfort of the passengers.

FIG. 1 schematically shows an automotive active brake noise damping system ABND which integrates the fruits of the Applicant's research aimed at reducing the braking noise generated by the braking assemblies BA of an automotive braking system BS and perceived in the passenger compartment of a motor vehicle MV during braking.

According to FIG. 1, the automotive active brake noise damping system ABND comprises:

a sensory system SENS designed to sense quantities that allow braking noise perceived in the passenger compartment of the motor vehicle MV and generated during braking by the braking assemblies BA associated with wheels W of the motor vehicle MV to be estimated, an audio system AS operable to diffuse sounds in the passenger compartment of the motor vehicle MV, and conveniently in the form of an audio section of an infotainment system of the motor vehicle MV, and an electronic control unit ECU, conveniently in the form of a body computer of the motor vehicle MV, connected to the sensory system SENS and to the audio system AS through an automotive on-board communication network NET, such as a CAN network, a FlexRAy network or other networks, and programmed to actively damp the braking noise perceived in the passenger compartment of the motor vehicle MV and generated by the braking assemblies BA of the braking system BS of the motor vehicle MV during braking based on the quantities sensed by the sensory system SENS and, in particular, to control the audio system AS based on the quantities sensed by the sensor system SENS so as to diffuse in the passenger compartment of the motor vehicle MV a sound that is such as to reduce and even cancel, when possible, the braking noise perceived in the passenger compartment and generated by the braking assemblies BA of the braking system BS of the motor vehicle MV during braking.

According to an aspect of the invention, the sensory system SENS comprises vibration sensors VS, conveniently in the form of piezoelectric accelerometers, directly coupled to the braking assemblies BA so as to sense vibrations generated by the braking assemblies BA during braking and to output electric signals indicative of the intensity of the vibrations.

In particular, the vibration sensors VS are applied in areas of the braking assemblies BA that are identified during the prototyping phase of a new motor vehicle MV and correspond to the areas in which, during braking, vibrations arise and generate a noise that can be perceived in the passenger compartment of the motor vehicle MV.

Figure 2:
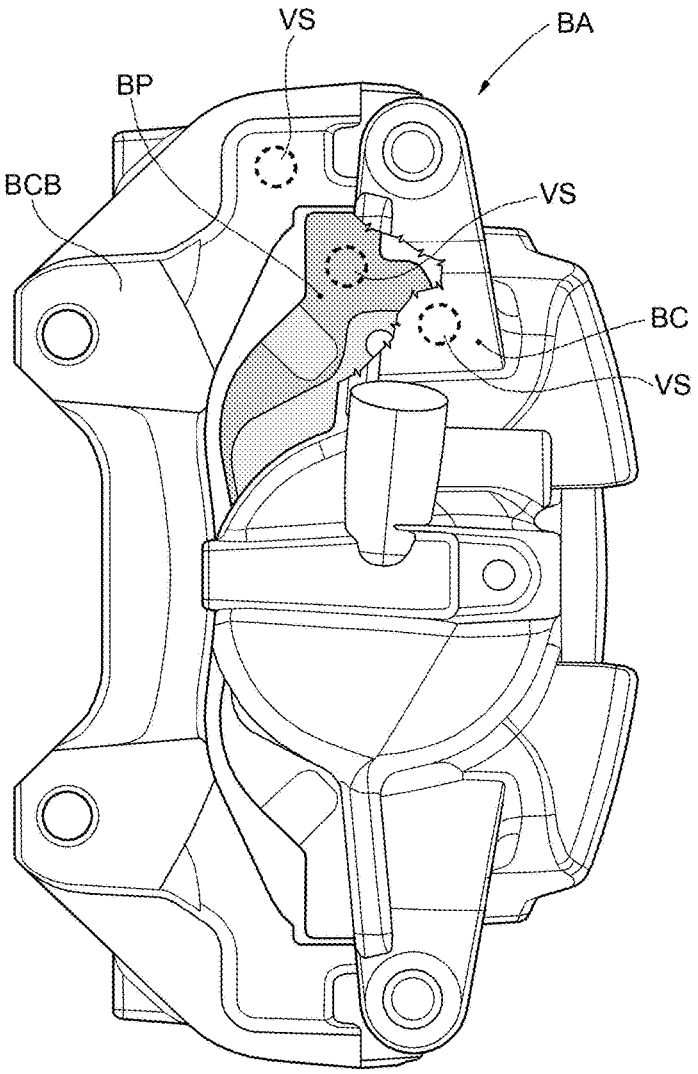
FIG. 2 shows possible arrangements of a vibration sensor in an automotive braking assembly for the provision of the automotive active noise control system shown in FIG. 1.

FIG. 2 shows possible arrangements of a vibration sensor VS in a braking assembly BA, in particular on a brake pad BP, on a brake caliper BC, or on the brake caliper bracket BCB.

Furthermore, during the prototyping phase, the braking noise perceived in the passenger compartment of the motor vehicle MV and generated by the braking assemblies BA of the braking system BS of the motor vehicle MV during braking is characterized and correlated to the vibrations generated by the braking assemblies BA, so as to experimentally define a mathematical model or a transfer function that, after being properly stored in the electronic control unit ECU, allows, during use of a motor vehicle MV provided with a type of braking assemblies BA identical to the one tested during the prototyping phase, to estimate the braking noise perceived in the passenger compartment of the motor vehicle MV and generated by the braking assemblies BA during braking as a function of the vibrations of the braking assemblies BA of the braking system BS of the motor vehicle MV, which are sensed by the vibration sensors VS applied to the braking assemblies BA.

In order to actively damp the braking noise perceived in the passenger compartment of the motor vehicle MV and generated by the braking assemblies BA of the braking system BS of the motor vehicle MV, the electronic control unit ECU is programmed to:

store the transfer function, which was experimentally defined during the prototyping phase of a new motor vehicle MV, in any suitable form, for example in the form of a look-up table (LUT), which is a data table structured so as to associate every input combination (for example frequencies and amplitudes of the vibrations of the braking assemblies) with corresponding outputs (for example frequencies and amplitudes of the corresponding noise perceived in the passenger compartment);

estimate braking noise perceived in the passenger compartment of the motor vehicle MV and generated by the operation of the braking assemblies BA of the braking system BS of the motor vehicle MV during braking as a function of the vibrations sensed by the vibration sensors VS applied braking assemblies BA and of the stored transfer function; and actively damp the braking noise perceived in the passenger compartment of the motor vehicle MV and generated by the operation of the braking assemblies BA of the braking system BS of the motor vehicle MV based on the braking noise estimated in the passenger compartment of the motor vehicle MV and generated by the operation of the braking assemblies BA of the braking system BS of the motor vehicle MV while braking.

In particular, in order to actively damp the braking noise perceived in the passenger compartment of the motor vehicle MV and generated by the operation of the braking assemblies BA of the braking system BS of the motor vehicle MV, the electronic control unit ECU is programmed to:

compute an interfering sound to be diffused in the passenger compartment of the motor vehicle MV based on the braking noise estimated in the passenger compartment of the motor vehicle MV and generated by the operation of the braking assemblies BA of the braking system BS of the motor vehicle MV during braking, the interfering noise being such as to disruptively interfere, when diffused in the passenger compartment of the motor vehicle MV, with the braking noise perceived in the passenger compartment of the motor vehicle MV, to such an extent to reduce or even cancels, when possible, the braking noise, and control the audio system AS to cause it to diffuse the computed interfering sound in the passenger compartment of the motor vehicle MV.

Computation of the transfer function which allows the noise perceived in the passenger compartment of the motor vehicle MV to be correlated to the vibrations of the braking assemblies BA, comprises computing a frequency spectrum of the vibrations of each braking assembly BA during braking based on the electric signals from the vibration sensors applied to the braking assembly BA and, then, computing the power spectrum of the noise perceived in the passenger compartment of the motor vehicle MV and generated by the braking assemblies BA during braking based on the frequency spectrum of the vibrations of the braking assemblies BA, using known numerical techniques, which will not be described in detail herein, as they are not part of the invention.

Similarly, computation of the interfering sound to be diffused in the passenger compartment of the motor vehicle MV basically comprises computing the frequency spectrum of the interfering sound using known numerical techniques, which will not be described in detail herein, as they are not part of the invention.

The advantages that the present invention allow to achieve are readily appreciable.

In particular, compared to the solution described in DE 43 05 217 A1, the invention implements an active noise control that fails to require expensive sound sensors arranged in the passenger compartment but that simply uses cheaper vibration sensors applied to the braking assemblies to sense vibrations thereof and then estimates the noise generated by the braking assemblies and perceived in the passenger compartment based on the sensed vibrations.

What is claimed is:

1. An automotive active brake noise damping system (ABND) to actively damp braking noise perceivable in the passenger compartment of a motor vehicle (MV) comprising a braking system (BS) comprising a plurality of braking assemblies (BA) associated with wheels (W) of the motor vehicle (MV), the automotive active brake noise damping system (ABNR) comprising:

a sensory system (SENS) to sense quantities that allow the braking noise perceived in the passenger compartment of the motor vehicle (MV) and generated by the braking assemblies (BA) of the braking system (BS) of the motor vehicle (MV) during braking to be estimated, an audio system (AS) to diffuse sounds in the passenger compartment of the motor vehicle (MV), and an electronic control unit (ECU) connected to the sensory system (SENS) and the audio system (AS), and programmed to control the audio system (AS) based on the quantities sensed by the sensory system (SENS) so as to actively damp the braking noise perceived in the passenger compartment of the motor vehicle (MV) and generated by the braking assemblies (BA) of the braking system (BS) of the motor vehicle (MV) during braking;

the automotive active brake noise damping system (ABND) is characterized in that:

the sensory system (SENS) comprises vibration sensors (VS) applied to the braking assemblies (BA) of the braking system (BS) of the motor vehicle (MV) to sense quantities indicative the vibrations generated by the braking assemblies (BA) of the braking system (BS) of the motor vehicle (MV) during braking;

and in that the electronic control unit (ECU) is further programmed to:

store a mathematical model which correlates vibrations generated by the braking assemblies (BA) of the braking system (BS) of the motor vehicle (MV) during braking with corresponding braking noise perceived in the passenger compartment of the motor vehicle (MV) and produced by the braking assemblies (BA) of the braking system (BS) of the motor vehicle (MV) during braking;

estimate the braking noise perceived in the passenger compartment of the motor vehicle (MV) and generated by the braking assemblies (BA) of the braking system (BS) of the motor vehicle (MV) during braking as a function of the vibrations generated by the braking assemblies (BA) of the braking system (BS) of the motor vehicle (MV) during braking and sensed by the vibration sensors (VS) applied to the braking assemblies (BA) and of the stored mathematical model;

compute an interfering sound to be diffused in the passenger compartment of the motor vehicle (MV) so as to damp the braking noise perceived in the passenger compartment of the motor vehicle (MV) and generated by the braking assemblies (BA) of the braking system (BS) of the motor vehicle (MV) during braking, and control the audio system (AS) to cause it to diffuse the computed interfering sound.

2. The automotive active brake noise damping system (ABND) of claim 1, wherein the vibration sensors (VS) are piezoelectric accelerators.

3. The automotive active brake noise damping system (ABND) of claim 1, wherein the vibration sensors (VS) are applied to the braking assemblies (BA) of the braking system (BS) of the motor vehicle (MV) in areas that, during a prototyping phase of a new motor vehicle (MV), are identified as areas in which, during braking, vibrations arise and generate a noise that can be perceived in the passenger compartment of the motor vehicle (MV).

4. A motor vehicle (MV) comprising:

an automotive braking system (BS) comprising a plurality of braking assemblies (BA) associated with wheels (W) of the motor vehicle (MV), and an automotive active brake noise damping system (ABND) according to claim 1.

* * * * *